US008764335B2

(12) United States Patent
Uehara

(10) Patent No.: US 8,764,335 B2
(45) Date of Patent: Jul. 1, 2014

(54) LIQUID APPLICATOR

(75) Inventor: Junya Uehara, Fujioka (JP)

(73) Assignee: Mitsubishi Pencil Company, Limited, Shinagawa-ku, Tokyo (JP)

( * ) Notice: Subject to any disclaimer, the term of this patent is extended or adjusted under 35 U.S.C. 154(b) by 729 days.

(21) Appl. No.: 13/055,966

(22) PCT Filed: Aug. 7, 2009

(86) PCT No.: PCT/JP2009/064025

§ 371 (c)(1),
(2), (4) Date: Jan. 26, 2011

(87) PCT Pub. No.: WO2010/016572

PCT Pub. Date: Feb. 11, 2010

(65) Prior Publication Data

US 2011/0129288 A1 Jun. 2, 2011

(30) Foreign Application Priority Data

Aug. 8, 2008 (JP) ..... 2008-206030

(51) Int. Cl.
*B43M 11/06* (2006.01)

(52) U.S. Cl.
USPC ..... 401/265; 401/263; 401/172

(58) Field of Classification Search
USPC ..... 401/261, 263, 265, 171, 172, 173
See application file for complete search history.

(56) References Cited

U.S. PATENT DOCUMENTS 7,168,878 B2 * 1/2007 Tani ..... 401/270
7,891,899 B2 * 2/2011 Tani ..... 401/266

(Continued)

FOREIGN PATENT DOCUMENTS

JP 2002-010829 A 1/2002
JP 2005-087562 A 4/2005

(Continued)

OTHER PUBLICATIONS

English translation of the International Preliminary Report on Patentability (PCT/IB/338) from the International Bureau of WIPO issued in corresponding International Application No. PCT/JP2009/064025 dated Mar. 17, 2011.

(Continued)

*Primary Examiner* — David Walczak
(74) *Attorney, Agent, or Firm* — Buchanan Ingersoll & Rooney PC

(57) ABSTRACT

A liquid applicator which, in its assembled state an applying part, joint, and front barrel are fixed to a barrel body front end portion, the step of an indented/projected engaging portion on the inner peripheral side of the applying part rear end portion is abutted from behind against and engaged with the step of an indented/projected engaging portion on the outer peripheral side of the forward part of the joint. At the same time, an indented/projected engaging portion on the outer peripheral side of the applying part rear end portion is abutted against and engaged with an indented/projected engaging portion on the inner peripheral side of the front barrel's forward part, and an indented/projected engaging portion on the inner peripheral side of the front barrel rearward part is engaged with an indented/projected engaging portion on the outer peripheral side in the rearward part of joint, whereby applying part, joint and front barrel are formed so as to fix the applying part to barrel body by means of the joint and the front barrel.

7 Claims, 8 Drawing Sheets

(56) References Cited

U.S. PATENT DOCUMENTS

| | | | | |
|---|---|---|---|---|
| 2003/0156886 | A1 | 8/2003 | Akaishi | |
| 2005/0063768 | A1 | 3/2005 | Tani | |
| 2009/0297252 | A1 * | 12/2009 | Prague | 401/265 |
| 2010/0232866 | A1 | 9/2010 | Umeno et al. | |

FOREIGN PATENT DOCUMENTS

| | | | |
|---|---|---|---|
| JP | 3109917 | U | 6/2005 |
| JP | 2006-149946 | A | 6/2006 |
| JP | 2007-130157 | A | 5/2007 |
| JP | 2007-236529 | A | 9/2007 |

OTHER PUBLICATIONS

International Search Report (PCT/ISA/210) issued on Sep. 8, 2009, by Japanese Patent Office as the International Searching Authority for International Application No. PCT/JP2009/064025.

* cited by examiner

LIQUID APPLICATOR

TECHNICAL FIELD

The present invention relates to a liquid applicator that stores an application liquid such as a fluid cosmetic or the like in a reservoir arranged in a barrel, has an applying part arranged at the front end of the barrel and made of a soft elastic body that is put into contact with a target site, and pushes out the application liquid stored in the reservoir by means of a delivering mechanism located at the end part of the barrel, wherein the applying part capable of applying the application liquid to a target site such as a skin as it is being slid over the target site is disposed in the barrel so as not to fall off.

BACKGROUND ART

In general, an applicator (liquid applicator) for applying a liquid cosmetic etc., with an applying part is adapted to push the application liquid from a reservoir arranged in the barrel to the ejection port of the soft applying part arranged at the barrel tip so as to be able to apply the application liquid to a target site as this applying part is being slid over the target site such as a skin or the like.

The liquid applicators having an applying part made of silicone resin have been conventionally disclosed by Japanese Utility Model Registered No. 3109917 (Patent Document 1) and Japanese Patent Application Laid-open 2006-149946 (Patent Document 2).

In Patent Document 1, the body of the applying part is fixed to the mouth of the cosmetic reservoir tube by nipping the proximal part (rear end) of the applying part from the inside and the outside between an inner annular seat and an outer annular seat, wherein the inner annular seat and outer annular seat are formed integrally, and fixing the inner annular seat and outer annular seat to the mouth of the reservoir tube.

However, the attachment structure of Patent Document 1 not only needs a technique of a high order in order to integrally form the inner annular seat and outer annular seat, facing difficulties in forming and resulting in high cost, but it is also difficult to obtain an appropriate nipping force for nipping the body of the applying part so that the seats and/or the applying part are prone to be broken during use, causing trouble.

On the other hand, in Patent Document 2, an applying part is integrally formed at the front end of a container body made of transparent plastic, and a jagged part (undercut) at the rear end of the container body end is fitted to a jagged part (undercut) at the rear end of an inner sleeve to thereby establish fixture therebetween.

However, since in this technique, engagement is created by only one undercut of the inner sleeve, it is not the one that can produce high enough fixing force.

Accordingly, the conventional liquid applicators entail the fear, for example that the applying part comes off due to a wiping operation of wiping up the soil of the liquid around the applying part, the liquid leaks out, smudging garments, and also the fear that the applying part cannot be re-attached even if it is tried to.

PRIOR ART DOCUMENTS

Patent Documents

Patent Document 1:
Japanese Utility Model Registered No. 3109917

Patent Document 2:
Japanese Patent Application Laid-open 2006-149946.

SUMMARY OF THE INVENTION

Problems to be Solved by the Invention

In view of the above conventional problems, it is an object of the present invention to provide a liquid applicator that can be easily assembled and whose applying part, front barrel and joint will not easily come off from each other.

Means for Solving the Problems

One aspect of the present invention provides a liquid applicator that stores an application liquid such as a fluid cosmetic or the like in a reservoir arranged in a barrel body, has an applying part that is fixed at the front end portion of the barrel body by means of a joint and a front barrel and brought into contact with a target site to apply the application liquid, and pushes out the application liquid stored in the reservoir toward the applying part by means of a delivering mechanism arranged in the rear of the barrel body, and is characterized in that the applying part is an overall cylindrical body that is formed of a soft elastic material and has an opening as an ejection port at the front end portion thereof and a communication hole at the rear end thereof for creating communication from the ejection port and an indented/projected engaging portion formed on, at least, the inner peripheral side in the rear end portion, the joint is an overall hollow cylindrical body having an application liquid passage hole formed therein and indented/projected engaging portions formed on the outer peripheral side in the forward part and rearward part, and the front barrel is an overall hollow cylindrical body having an indented/projected engaging portion formed on the inner peripheral side in the rearward part, and, in the assembled state where the joint forward part is inserted in the communication hole of the applying part rear end portion while the outer periphery of the applying part rear end portion is covered by the front barrel forward part and the front barrel rearward part is fixed to the barrel body front end portion, the indented/projected engaging portion on the inner peripheral side of the applying part rear end portion is engaged with the indented/projected engaging portion on the outer peripheral side of the joint forward part, at the same time the indented/projected engaging portion on the inner peripheral side of the front barrel rearward part is engaged with the indented/projected engaging portion on the outer peripheral side of the join rearward part, whereby the applying part, joint and front barrel are formed so as to fix the applying part to the barrel body by means of the joint and the front barrel.

A further aspect of the present invention provides a liquid applicator that stores an application liquid such as a fluid cosmetic or the like in a reservoir arranged in a barrel body, has an applying part that is fixed at the front end portion of the barrel body by means of a joint and a front barrel and brought into contact with a target site to apply the application liquid, and pushes out the application liquid stored in the reservoir toward the applying part by means of a delivering mechanism arranged in the rear of the barrel body, and is characterized in that the applying part is an overall cylindrical body that is formed of a soft elastic material and has an opening as an ejection port at the tip thereof and a communication hole at the rear end thereof for creating communication from the ejection port and indented/projected engaging portions formed on the inner peripheral side and the outer peripheral side in the rear end portion, the joint is an overall hollow cylindrical body having an application liquid passage hole formed therein and indented/projected engaging portions formed on the outer peripheral side in the forward part and rearward part, and the front barrel is an overall hollow cylindrical body having indented/projected engaging portions formed on the inner peripheral side in the forward part and the rearward part, and, in the assembled state where the joint forward part is inserted in the communication hole of the applying part rear end portion while the outer periphery of the applying part rear end portion is covered by the front barrel forward part and the front barrel rearward part is fixed to the barrel body front end portion, the indented/projected engaging portion on the inner peripheral side of the applying part rear end portion is engaged with the indented/projected engaging portion on the outer peripheral side of the joint forward part, and the indented/projected engaging portion on the outer peripheral side of the applying part rear end portion is engaged with the indented/projected engaging portion on the inner peripheral side of the front barrel forward part, at the same time the indented/projected engaging portion on the inner peripheral side of the front barrel rearward part is engaged with the indented/projected engaging portion on the outer peripheral side in the join rearward part, whereby the applying part, joint and front barrel are formed so as to fix the applying part to the barrel body by means of the joint and the front barrel.

A further aspect of the present invention is characterized in that, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the spacing between the indented/projected engaging portion on the outer peripheral side of the joint forward part and the indented/projected engaging portion on the inner peripheral side of the front barrel forward part is formed to be narrower than the dimension between the indented/projected engaging portions on the inner and outer periphery surfaces of the applying part rear end portion so that the portion between the indented/projected engaging portions on the inner and outer peripheral surfaces of the applying part rear end portion is deformed by exerting compressive stress on that portion.

A further aspect of the present invention is characterized in that the inner and outer peripheries of the applying part rear end portion, the joint outer periphery and the front barrel inner periphery are formed with flat surface portions in the areas other than respective indented/projected engaging portions, and, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the opposing flat surface portions on the applying part inner periphery and the joint outer periphery are formed so as to come into close contact with each other while the opposing surface portions on the applying part outer periphery and the front barrel inner periphery are formed so as to come into close contact with each other.

A further aspect of the present invention is characterized in that a flange portion is formed with a greater diameter at the joint rear end, and, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the flange portion is adapted to abut the rear end of the front barrel from behind.

A further aspect of the present invention is characterized in that an indented/projected engaging portion is formed on the inner peripheral side of the front end portion of the barrel body while an indented/projected engaging portion is formed on the outer peripheral side of the front barrel rearward part, so that the indented/projected engaging portion on the inner peripheral side of the barrel body's front end portion is engaged with the indented/projected engaging portion on the outer peripheral side of the front barrel rearward part, whereby the applying part is fixed to the barrel body by means of the joint and the front barrel, and, in the above assembled state, the first engagement position where the indented/projected engaging portion on the inner peripheral side of the barrel body's front end portion and the indented/projected engaging portion on the outer peripheral side of the front barrel rearward part engage with each other and the second engagement position where the indented/projected engaging portion on the inner peripheral side of the front barrel rearward part and the indented/projected engaging portion on the outer peripheral side of the joint rearward part with each other, are formed at the same position or at positions near to each other with respect to the axial direction.

A further aspect of the present invention is characterized in that the applying part is configured so that the tip applying surface is formed to be a flat surface or a projected spherical surface.

A further aspect of the present invention is characterized in that the applying part is formed of transparent or translucent silicone resin or urethane resin.

Effect of the Invention

According to the liquid applicator of one aspect of the present invention, in the aforementioned assembled state, the indented/projected engaging portion on the inner peripheral side of the applying part rear end portion is engaged with the indented/projected engaging portion on the outer peripheral side of the joint forward part, at the same time the indented/projected engaging portion on the inner peripheral side of the front barrel rearward part is engaged with the indented/projected engaging portion on the outer peripheral side of the join rearward part, whereby the applying part, joint and front barrel are formed so as to fix the applying part to the barrel body by means of the joint and the front barrel.

Also, according to the liquid applicator of a further aspect of the present invention, in the aforementioned assembled state, the indented/projected engaging portion on the inner peripheral side of the applying part rear end portion is engaged with the indented/projected engaging portion on the outer peripheral side of the joint forward part, and the indented/projected engaging portion on the outer peripheral side of the applying part rear end portion is engaged with the indented/projected engaging portion on the inner peripheral side of the front barrel forward part, at the same time the indented/projected engaging portion on the inner peripheral side of the front barrel rearward part is engaged with the indented/projected engaging portion on the outer peripheral side in the join rearward part, whereby the applying part, joint and front barrel are formed so as to fix the applying part to the barrel body by means of the joint and the front barrel.

Accordingly, it is possible with a simple structure to firmly fix the rear end portion of the applying part from the inside and outside and also produce robust fixture between the joint and the front barrel. As a result, the applying part, front barrel and joint will not come off easily. Further, simple assembling is enabled since the fixture can be created by engagement and fitting between indented/projected engaging portions.

According to a further aspect of the present invention, the spacing between the indented/projected engaging portion on the outer peripheral side of the joint forward part and the indented/projected engaging portion on the inner peripheral side of the front barrel forward part is formed to be narrower than the dimension between the indented/projected engaging portions on the inner and outer periphery surfaces of the applying part rear end portion so that the portion between the indented/projected engaging portions on the inner and outer peripheral surfaces of the applying part rear end portion is deformed by exerting compressive stress on that portion. As a result, deformation of the applying part due to compressive stress makes it possible to fix the applying part more firmly.

According to a further aspect of the present invention, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the opposing flat surface portions on the applying part inner periphery and the joint outer periphery are formed so as to come into close contact with each other while the opposing surface portions on the applying part outer periphery and the front barrel inner periphery are formed so as to come into close contact with each other. As a result, the flat surfaces of the applying part's inner periphery and the joint's outer periphery are put into close contact with each other and the flat surfaces of the applying part's outer periphery and the front barrel's inner periphery are put into close contact with each other to thereby improve liquid-tightness and make it difficult to be distorted and hence coming off.

According to a still further aspect of the present invention, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the flange portion is adapted to abut the rear end of the front barrel from behind. As a result, it is possible to prevent the joint from sinking into the front barrel.

According to a yet further aspect of the present invention, in the above assembled state, the first engagement position where the indented/projected engaging portion on the inner peripheral side of the barrel body's front end portion and the indented/projected engaging portion on the outer peripheral side of the front barrel rearward part engage with each other and the second engagement position where the indented/projected engaging portion on the inner peripheral side of the front barrel rearward part and the indented/projected engaging portion on the outer peripheral side of the joint rearward part with each other, are formed at the same position or at positions near to each other with respect to the axial direction. As a result, the engaging force between the front barrel and joint does not depend on the elastic force of the barrel but the elastic force of the barrel body is added, so that the joint is further unlikely to come off from the front barrel.

According to another aspect of the present invention, when the tip applying surface configuration is formed to be a flat surface, a greater area comes into contact with the target site, hence improving application performance. On the other hand, when the tip applying surface configuration is formed to be a projected spherical surface, the applied cosmetic liquid will be less raked by another surface of the applying part after application to the target site, hence application performance is improved.

According to yet another aspect of the present invention, since the applying part is formed of transparent or translucent silicone resin or urethane resin, it is possible to provide an applicator excellent in visibly recognizing the state of the application liquid and hence in aesthetic appearance.

MODES FOR CARRYING OUT THE INVENTION

Now, the embodiments of the present invention will be described with reference to the accompanying drawings.

Figure 1:
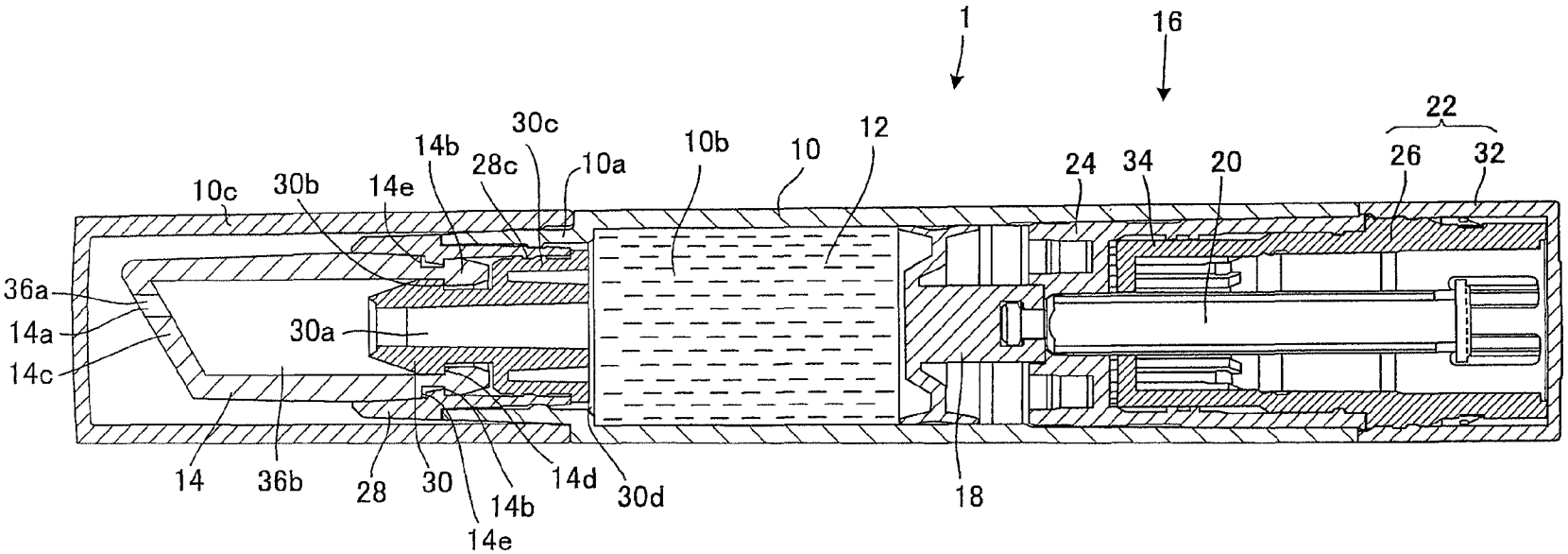
FIG. 1 is an illustrative view of embodiment 1 of a liquid applicator according to the present invention, showing an overall illustrative and sectional view of the liquid applicator.
Figure 2:
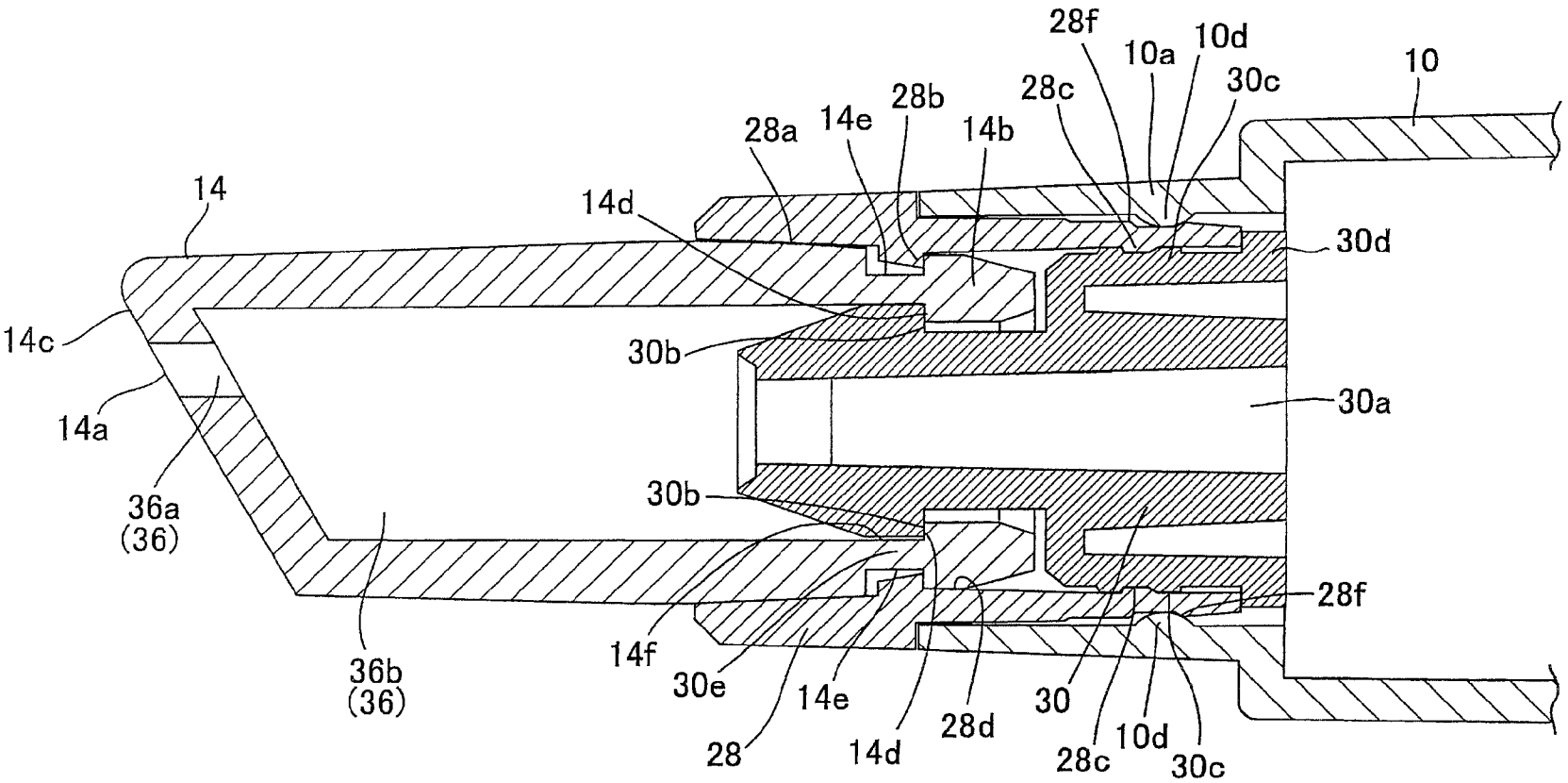
FIG. 2 is an illustrative view showing a joint and a front barrel built (assembled) with an applying part of the liquid applicator of FIG. 1.
Figure 3B:
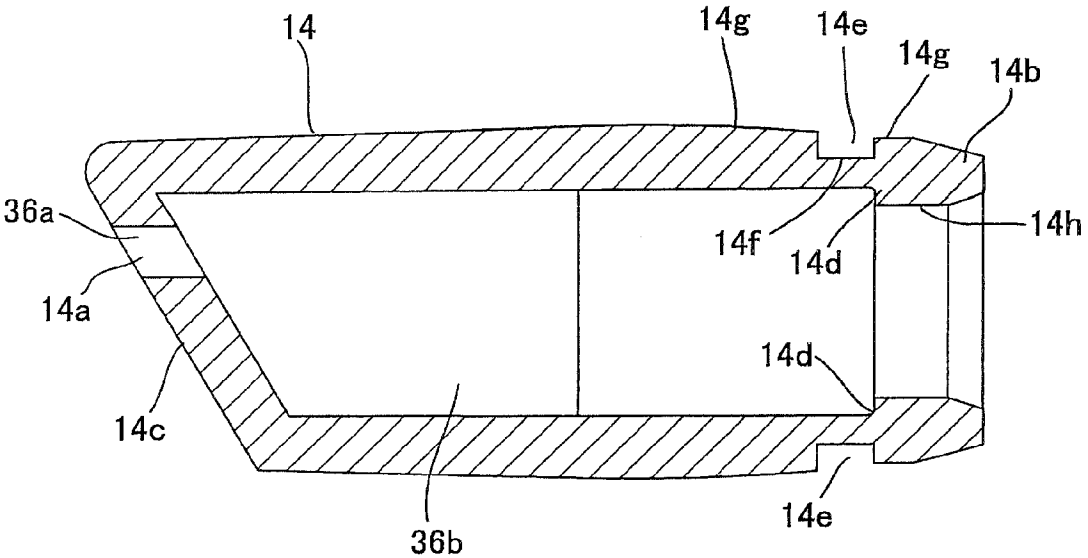
FIGS. 3 (*a*) and (*b*) are a view from the front, and a vertical sectional view, of an applying part of the liquid applicator of FIG. 1.
Figure 3A:
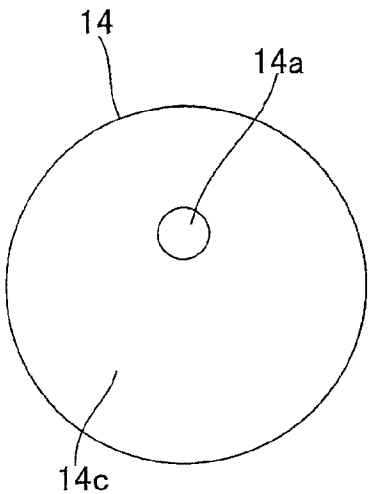
Figure 4B:
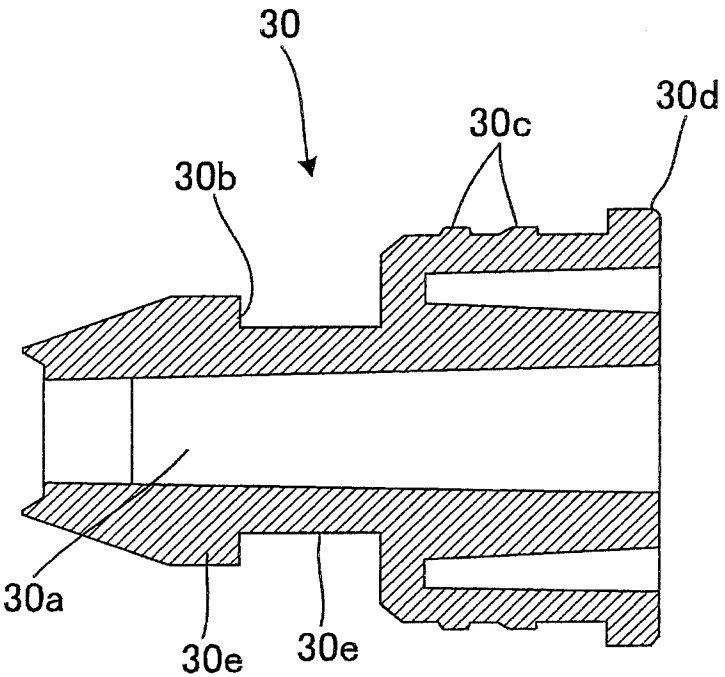
FIGS. 4 (*a*) and (*b*) are a side view and a sectional view of a joint of the liquid applicator of FIG. 1.
Figure 4A:
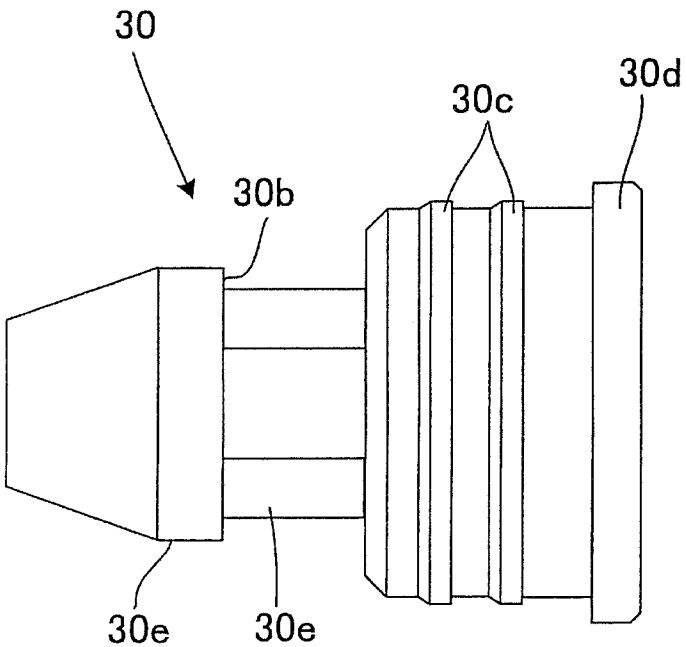
Figure 5B:
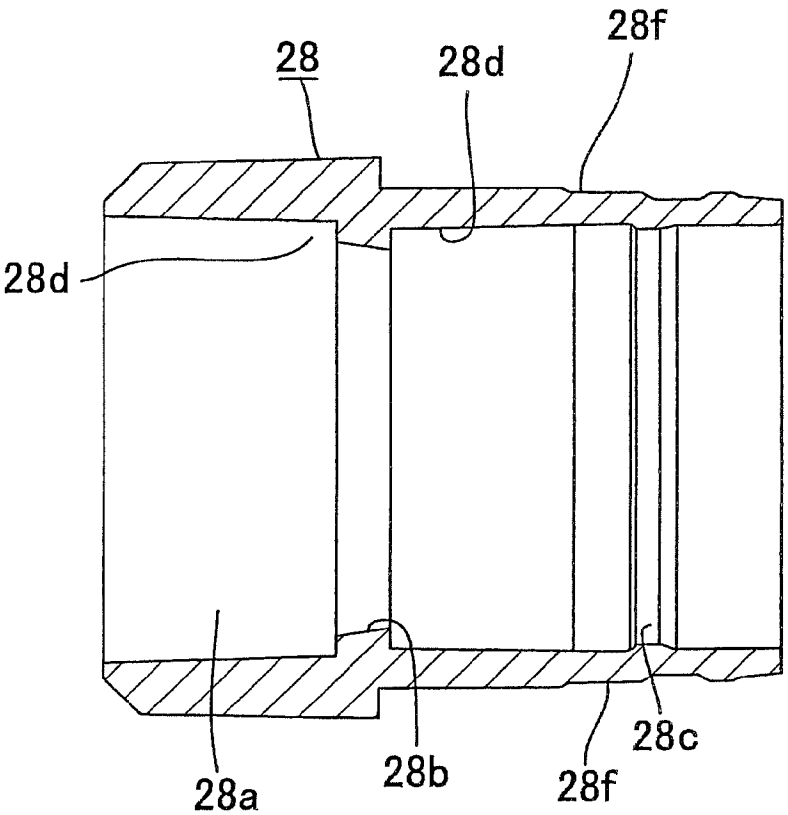
FIGS. 5 (*a*) and (*b*) are a side view and a sectional view of a front barrel of the liquid applicator of FIG. 1.
Figure 5A:
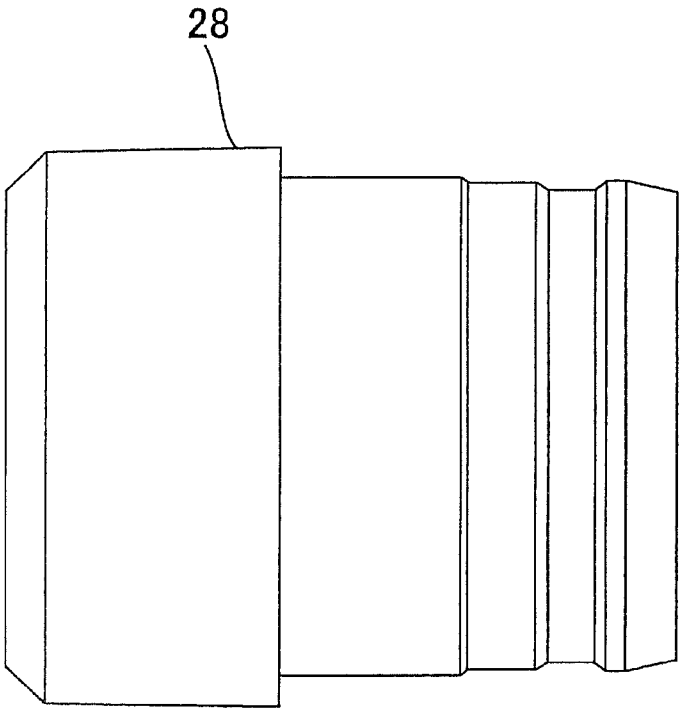
Figure 6D:
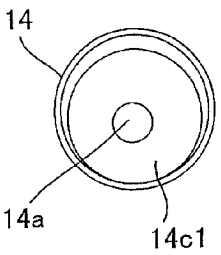
FIG. 6 is an illustrative view of embodiment 2 of a liquid applicator according to the present invention, (a) a side view of an applying part, (b) a vertical sectional view of an applying part, (c) an underside view of an applying part, (d) a front view of an applying part, (e) a vertical sectional illustrative view showing an applying part built (assembled) with a joint and a front barrel, and (f) a side view of the assembled state.
Figure 6E:
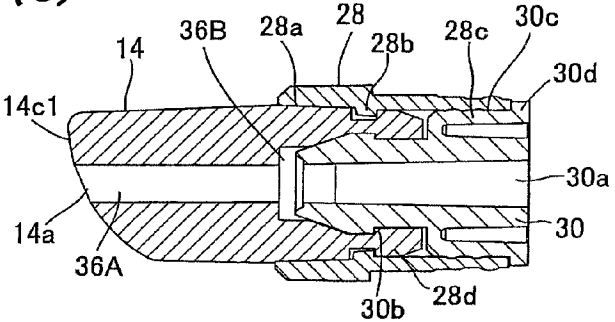
Figure 6F:
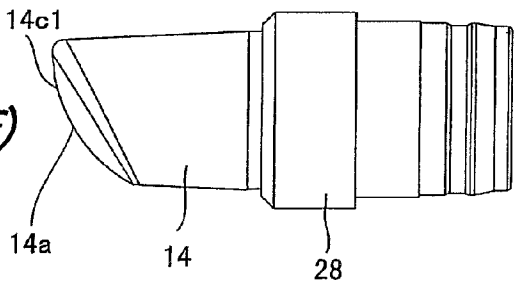
Figure 6A:
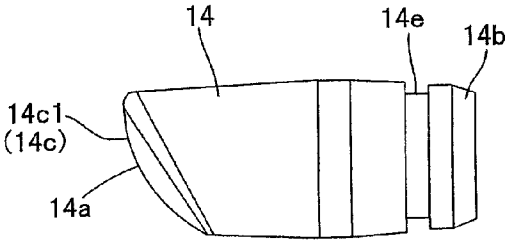
Figure 6B:
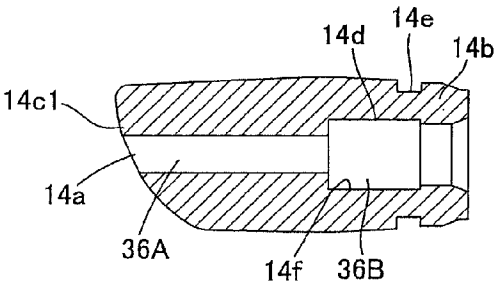
Figure 6C:
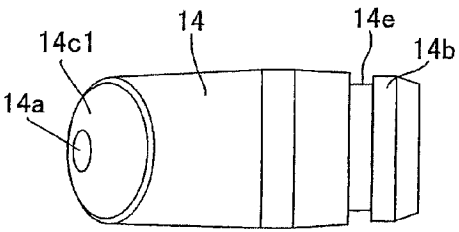

FIGS. 1 to 5 are illustrative views of embodiment 1 of a liquid applicator of the present invention. FIG. 1 is an overall illustrative and sectional view of the liquid applicator. FIG. 2 is an illustrative view showing a joint and a front barrel built (assembled) with an applying part. FIGS. 3(*a*) and (*b*) are a view from the front, and a vertical sectional view, of an applying part. FIGS. 4 (*a*) and (*b*) are a side view and a sectional view of a joint. FIGS. 5(*a*) and (*b*) are a side view and a sectional view of a front barrel.

Figure 7:
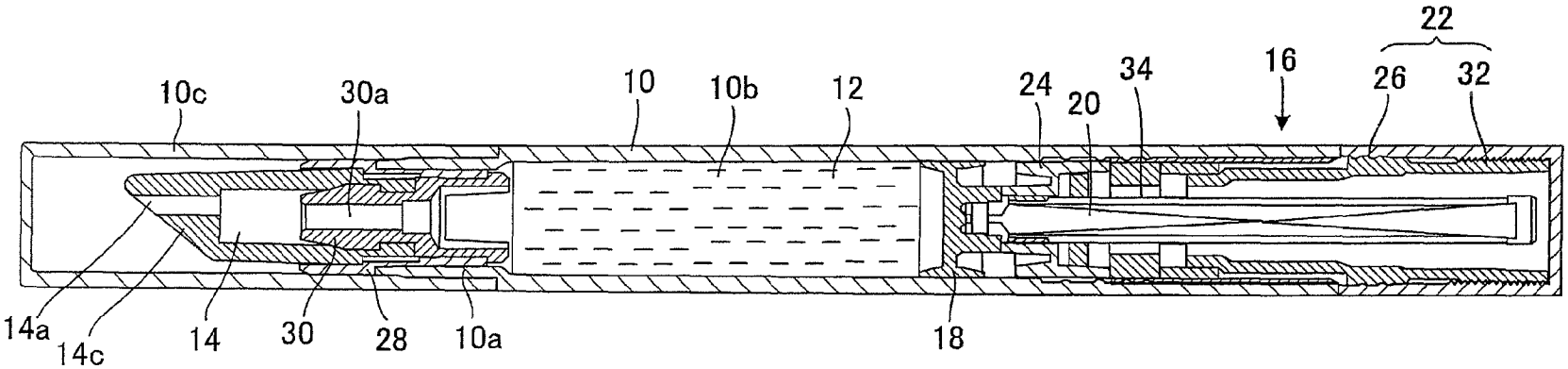
FIG. 7 is an illustrative view of embodiment 3 of a liquid applicator according to the present invention, showing an overall illustrative and sectional view of the liquid applicator.
Figure 8:
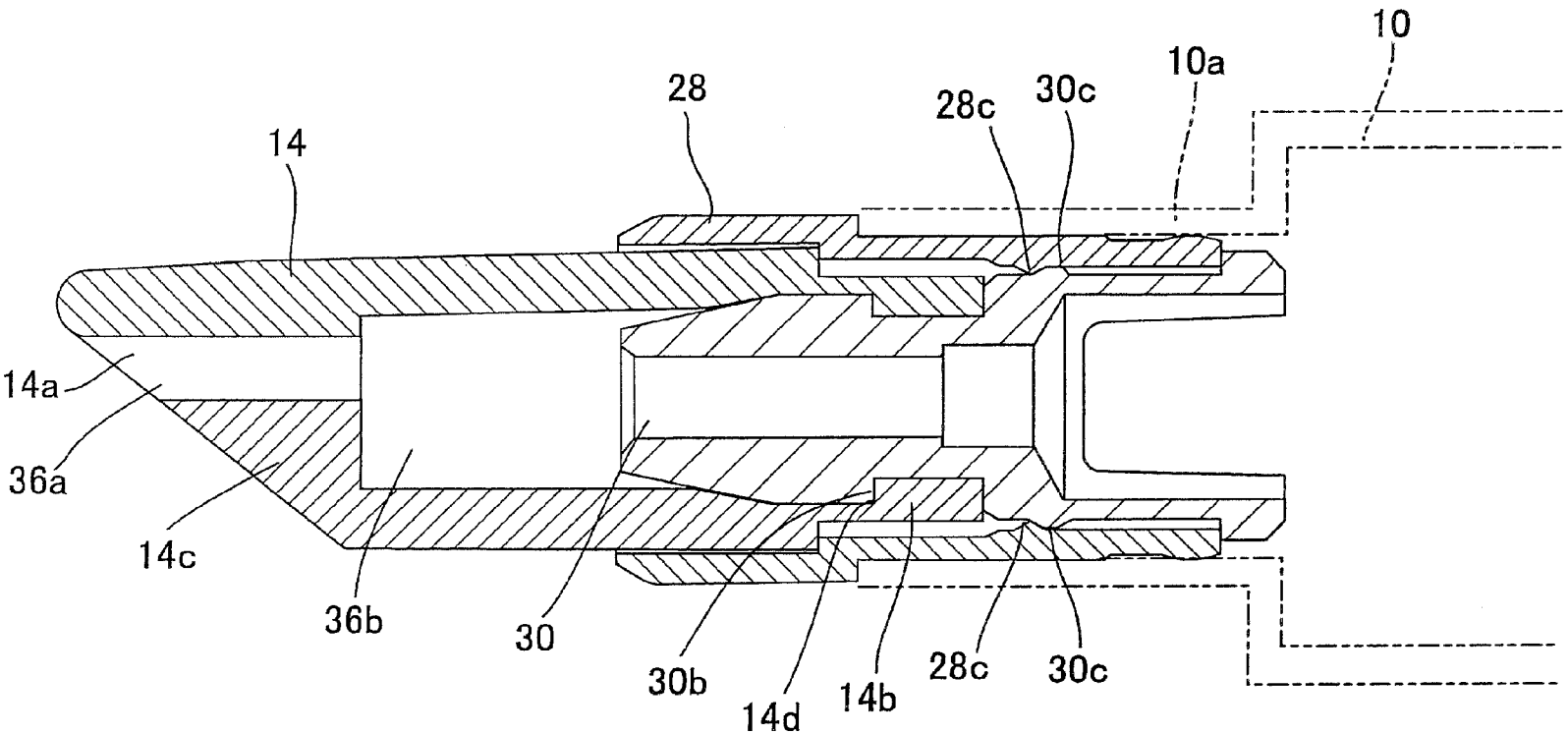
FIG. 8 is an illustrative view showing a joint and a front barrel built (assembled) with the applying part of FIG. 7.

FIGS. 6(*a*) to (*f*) are illustrative views of embodiment 2 of a liquid applicator according to the present invention. FIG. 7 is an overall illustrative and sectional view of embodiment 3 of a liquid applicator according to the present invention. FIG. 8 is an illustrative view showing a joint and a front barrel built (assembled) with the applying part of FIG. 7.

As shown in FIG. 1, the liquid applicator according to the embodiment is a liquid cosmetic applicator 1 that stores an application liquid 12 such as cosmetics etc. in a reservoir 10*b* arranged inside a barrel body 10, is fixed at a front end portion 10*a* of barrel body 10 with an applying part 14 that is brought into contact with a target site such as a skin etc. of the user for application, and is adapted to push the cosmetics stored in reservoir 10*b* of barrel body 10 from an ejection port 14*a* of applying part 14 by means of a delivering mechanism 16 provided at the rear of barrel body 10.

Then, in this liquid cosmetic applicator 1, the fluid application liquid 12 such as cosmetics etc., held in reservoir 10*b* of the barrel body has a viscosity ranging from 0.3 Pa·sec to 50 Pa·sec under the condition where the shear rate is 5 $sec^{-1}$ at 25 deg.C.

The aforementioned delivering mechanism 16 includes: a piston body 18 that moves forwards and backwards relative to reservoir 10*b* inside the barrel body 10 so as to decrease and increase the volume of the interior reservoir space; and a drive mechanism (formed of a rotational actuator 22, a shaft-like member 20, a fixed cylinder 24, an inner sleeve 26 and others) in which the front end of shaft-like member 20 (also called "threaded rod") is engaged with the rear end of the piston body 18 so as to cause this piston body 18 to advance and retract by moving the shaft-like member 20 forwards and backwards by user's actuating force.

Detailedly, as shown in FIG. 1, liquid cosmetic applicator 1 includes, as its essential components, barrel body 10 as an outer sleeve, a front barrel 28, a joint 30, application liquid 12, delivering mechanism 16 and a cap 10*c*.

[Barrel Body 10]

Barrel body 10 has an overall hollow cylindrical configuration with its front end portion 10*a* tapered so that the outside diameter of front end portion 10*a* is formed to be approximately equal to the inside diameter of cap 10*c*. Cap 10*c* is removably fitted to the front end portion 10*a*. The opposing portions of front end portion 10*a* and cap 10*c* when fitted to each other are formed with jagged ribs, creating a jagged engagement therebetween so that cap 10*c* will not be removed from front end portion 10*a* by an unintentional force.

Front barrel 28 and joint 30 which hold the rear end portion (applying part rear end portion) 14*b* of applying part 14 is liquid-tightly fitted in the interior from the opening of front end portion 10*a* of barrel body 10 (with the rear end 14*b* of applying part 14 nipped between the inner peripheral side of the front barrel 28 engaged with the inner peripheral side of front end portion 10*a* of barrel body 10 and the outer peripheral side of joint 30 and fixed). Meanwhile, a delivering mechanism 16 is arranged at the rear end of barrel body 10.

Then, piston body (gasket) 18 of this delivering mechanism 16 is inserted into barrel body 10 from its rear opening so as to be slidable along, and in close contact with, the inner wall of the middle part of the main body.

Accordingly, the sectioned space enclosed by the interior of barrel body 10, the rear end portions of front barrel 28 and joint 30 and piston body 18 is formed as reservoir 10*b* for application liquid 12.

[Delivering Mechanism 16]

As shown in FIG. 1, in liquid cosmetic applicator 1 according to the embodiment, delivering mechanism 16 having an integrated configuration is arranged at the rear end of barrel body 10. The delivering mechanism 16 causes piston body 18 as a constituent thereof to slide liquid-tightly along the inner wall of the middle part of barrel body 10 by the user's actuation input, whereby the volume of the reservoir 10*b* is reduced or increased to thereby pressurize or depressurize application liquid 12.

Delivering mechanism 16 includes, as its essential components, rotational actuator 22, shaft-like member 20, fixed cylinder 24 for projecting and retracting this shaft-like member 20 (these correspond to the drive mechanism) and the aforementioned piston body 18.

The rotational actuator 22 is formed of an outer cylindrical cap 32 and inner sleeve 26 which are joined to each other in an unrotatable manner. The whole rotational actuator 22 is arranged rotatably relative to barrel body 10. Shaft-like member 20 is arranged so as to be slidable in the axial direction and fixed in the rotational direction relative to rotational actuator 22.

[Fixed Cylinder 24]

Fixed cylinder 24 is formed of an annular part and attached to barrel body 10 so as to be unrotatable and unable to move forwards and backwards. A female thread is formed on the inner periphery of fixed cylinder 24 so as to have the male thread on the outer periphery of shaft-like member 20 screw-fitted thereto. As rotational actuator 22 is turned, shaft-like member 20 rotates and is driven by the function of male thread of shaft-like member 20 that meshes the female thread of fixed cylinder 24, whereby piston body 18 moves forwards or backwards.

Further, a ratchet is created in the meshing portion 34 between fixed cylinder 24 and rotational actuator 22 (the outer peripheral side at the front of inner sleeve 26). Rotational actuator 22 is permitted to rotate in both directions relative to fixed cylinder 24 (barrel body 10 fixed to it). When the actuator is turned in one direction that allows ejection of the liquid cosmetic, the liquid cosmetic is dispensed while the fingers feel a clicking sensation from the ratchet. When the actuator is turned in the other direction, the actuator is restricted from rotating so as to turn when a stronger input than the set rotational force is applied. That is, a torque limiter function can be imparted so as to release the restriction and permit rotation when a rotational force equal to or greater than a fixed level is applied in the other direction.

Also, delivering mechanism 16 has a function of depressurizing application liquid 12 inside reservoir 10*b* of barrel body 10 by moving piston body 18 backward as the aforementioned rotational actuator 22 is turned in the other direction, whereby it is possible for the delivering mechanism 16 to depressurize application liquid 12 after delivering mechanism 16 has been stopped to pressurize application liquid 12 and draw back the liquid cosmetic into communication bore 36 (36*a* and 36*b*). Other than the above, it is also possible for delivering mechanism 16 to prohibit the liquid cosmetic from returning when the rotational restriction by the meshing portion 34 of the aforementioned rotational actuator 22 is adapted to stop rotation in the other direction.

[Rotational Actuator 22, Inner Sleeve 26]

Rotational actuator 22 is formed of outer cylindrical cap 32 and inner sleeve (also called "delivering body") 26 which are joined in such a manner as to be relatively unrotatable to each other under normal conditions and become rotatable relative to each other when a rotational force equal to or greater than a fixed level is applied. The whole rotational actuator 22 is arranged at the rear end of barrel body 10 in a rotatable manner.

[Applying Part 14]

As shown in FIGS. 2 to 3, the applying part 14 is an overall cylindrical body that is formed of a soft elastic material and has an opening as an ejection port 14*a* at the front end and communication holes 36*a* and 36*b* that are arranged at the rear end portion 14*b* and connected to the ejection port 14*a*. In rear end portion 14*b* of the applying part 14, stepped indented/projected engaging portions 14*d* and 14*e* are formed on the inner and outer peripheral sides. When application liquid 12 is pressurized by delivering mechanism 16, the application liquid is ejected from ejection port 14*a* by way of communication holes 36*a* and 36*b* and stays on the tip face 14*c*.

The friction coefficient of the elastic material used for applying part 14 ranges from 0.04 to 0.7. It is possible to adjust the friction coefficient by shaping: it is possible to reduce the friction coefficient by making the applying surface spherical or curving the applying surface by rounding the edge at the periphery; and it is also possible to produce a large frictional resistance by making the applying surface flat or having the surface formed with large bumpiness, and by making the edge at the periphery steep.

Applying part 14 has a cylindrical configuration with its front end cut obliquely forming a plane surface end (tip face 14*c*), and the tip face 14*c* has ejection port 14*a* formed on the side extended to the tip. Small-diametric communication hole 36*a* that communicates with the ejection port 14*a* is formed inside applying part 14. Formed inside applying part 14 is large-diametric communication hole 36*b* that opens from the halfway along the axial direction to the rear end 14*b* of applying part 14. The rear end of small-diametric communication hole 36*a* opens to the front end of large-diametric communication hole 36*b* establishing communication with each other. In the first embodiment, large-diametric communication hole 36*b* occupies the most part inside applying part 14, and applying part 14 has a thick-film configuration.

The stepped, reduced diametric portion near the rear end of large-diametric communication hole 36*b* forms indented/projected engaging portion 14*d* on the inner peripheral side of the applying part. On the other hand, the outer peripheral side of applying part 14 is depressed stepwise so that this depression forms indented/projected engaging portion 14*e*. In this way, the indented/projected engaging portion 14*e* of the present invention may include a depressed portion other than projected portions above the surface.

Applying part 14 is integrally formed of elastic resin which is transparent or translucent silicone resin or urethane resin so as to ensure the necessary application performance. It should be noted that front barrel 28 and joint 30 that hold the applying part 14 therebetween, the barrel cylinder and others are formed of resin so as to have such density and rigidity that ensure the necessary hermetic performance and supporting performance.

[Joint 30]

The joint 30 is an overall hollow cylindrical body having application liquid passage hole 30*a* formed therein and indented/projected engaging portions 30*b* and 30*c* formed on the outer peripheral side in the forward and rearward parts, as shown in FIGS. 2 and 4. The front barrel 28 is an overall hollow cylindrical body having a space 28*a* therein and indented/projected engaging portions 28*b* and 28*c* formed on the inner peripheral side in forward and rearward parts, as shown in FIGS. 2 and 5.

Detailedly, as shown in FIGS. 1, 2 and 4, joint 30 has an overall cylindrical configuration as a whole, becoming greater in diameter stepwise in the rearward portion than in the forward portion and having hollow application liquid passage hole 30*a* that penetrates through the interior thereof from the front to the rear in the axial direction and has a substantially uniform diameter from the front to the middle thereof in the axial direction. The forward part of joint 30 is formed to be gradually greater in diameter as it goes rearwards and reduced stepwise in diameter at a certain position, which forms the indented/projected engaging portion 30*b* in the forward part of joint 30 of the present invention. On the other hand, the large-diametric portion in the rearward part of joint 30 is formed on its outer peripheral side with a plurality of annular projected ribs or semicylindrical projections, which form indented/projected engaging portion 30*c* in the rearward part of joint 30.

Formed on the rear end, which is located further rearwards from the aforementioned indented/projected engaging portion 30*c* in the rearward part of the joint 30, is a flange portion 30*d* that is greater in diameter. The outside diameter of this flange portion 30*d* is formed to be greater than the outside diameter of indented/projected engaging portion 30*c* in the aforementioned rearward part.

[Front Barrel 28]

As shown in FIGS. 2 and 5, front barrel 28 is an overall hollow cylindrical body having a large diameter in the forward part and a small diameter in the rearward part. Formed on the inner peripheral side in the fore part of this front barrel 28 is an annular projected portion that is projected, or reduced stepwise in diameter, which forms indented/projected engaging portion 28*b* of the inner peripheral side of the forward part. In the rearward part of front barrel 28, a flat area is formed near to the rear end, where an annular projected rise is formed around the inner periphery, which forms indented/projected engaging portion 28*c* of the rearward part of front barrel 28. The inner periphery of the portion becomes slightly greater in diameter behind indented/projected engaging portion 28*c* on the rearward side, reaching the rear end part.

As to the material of each component in the embodiment, shaft-like member 20 and fixed cylinder 24 may be formed of ABS resin, piston 18 and front barrel 28 may be formed of HDPE (high-density polyethylene), barrel body 10, cap 10*c* and outer cylindrical cap 32 may be formed of PP (polypropylene). Each component may use other resin material as appropriate.

[Explanation on Engagement Relationship]

Now, description will be made on the engagement (fitting) relationship between engaging portions in the liquid applicator when applying part 14, front barrel 28 and joint 30 have been assembled in barrel body front end portion 10*a*.

As shown in FIGS. 1 and 2, in the assembled state where the forward part of joint 30 is inserted in communication hole 36*b* of the applying part rear end portion 14*b* while the outer periphery of the applying part rear end portion 14*b* is covered by the forward part of front barrel 28 and the front barrel rearward part is fixed to barrel body front end portion 10*a*, the step of indented/projected engaging portion 14*d* on the inner peripheral side of the applying part rear end portion 14*b* is abutted against and engaged with the step of indented/projected engaging portion 30*b* on the outer peripheral side of the forward part of the joint 30. Further, indented/projected engaging portion 14*e* on the outer peripheral side of the applying part rear end portion 14*b* is abutted against and engaged with indented/projected engaging portion 28*b* on the inner peripheral side of the forward part of the front barrel. At the same time, indented/projected engaging portion 28*c* on the inner peripheral side of the front barrel rearward part is engaged with indented/projected engaging portion 30*c* on the outer peripheral side of the rearward part of joint 30. Thus, applying part 14, joint 30 and front barrel 28 are formed so as to fix the applying part 14 to barrel body 10 by means of the joint 30 and the front barrel 28.

Here, in the liquid applicator of embodiment 1, as shown in FIGS. 1 and 2, when indented/projected engaging portion 14*d* on the inner peripheral side of the applying part rear end portion 14*b* is engaged with indented/projected engaging portion 30*b* on the outer peripheral side of the forward part of the joint 30 and when indented/projected engaging portion 14*e* on the outer peripheral side of the applying part rear end portion 14*b* is engaged with indented/projected engaging portion 28*b* on the inner peripheral side of the front barrel forward part, the spacing between indented/projected engaging portion 30*b* on the outer peripheral side of the joint 30's forward part and indented/projected engaging portion 28*b* on the inner peripheral side of the front barrel's forward part is preferably formed to be narrower than the dimension between the indented/projected engaging portions on the inner and outer peripheral surfaces of the applying part rear end portion 14*b* so that the portion between the indented/projected engaging portions 14*d* and 14*e* on the inner and outer peripheral surfaces of the applying part rear end portion 14*b* is deformed by exerting compressive stress on that portion. With this setting, applying part 14 is deformed by compressive stress, whereby it is possible to fix applying part 14 more firmly.

Further, as shown in FIGS. 3 to 5 the inner and outer peripheries of the applying part rear end portion 14*b*, the outer periphery of the joint 30 and the inner periphery of the front barrel 28 are formed with flat surface portions in the areas other than indented/projected engaging portions 14*d*, 14*e* of applying part rear end portion 14*b*, indented/projected engaging portion 30*b* of the forward part on the outer periphery of joint 30 and indented/projected engaging portion 28*b* in the forward part of front barrel 28. At least, either in the front or rear of each indented/projected engaging portion, flat surface portions 14*f* (inner side) and 14*g* (outer side) are formed in applying part 14 as shown in FIG. 3, a flat surface portion 30*e* is formed on the outer periphery of joint 30 as shown in FIG. 4, and a flat surface portion 28*d* is formed on the inner periphery of front barrel 28 as shown in FIG. 5.

As shown in FIGS. 1 and 2, in the state where indented/projected engaging portion 14*d* on the inner peripheral side of the applying part rear end portion 14*b* is engaged with indented/projected engaging portion 30*b* on the outer peripheral side of the forward part of the joint 30 and indented/projected engaging portion 14*e* on the outer peripheral side of the applying part rear end portion 14*b* is engaged with indented/projected engaging portion 28*b* on the inner peripheral side of the front barrel forward part, the opposing flat surface portions 14*f* and 30*e* on the inner periphery of the applying part 14 and the outer periphery of the joint are formed so as to come into close contact with each other while the opposing surface portions 14*g* and 28*d* on the outer periphery of the applying part 14 and the inner periphery of the front barrel are formed so as to come into close contact with each other. In this way, surface portions 14*f* and 30*e*, as well as surface portions 14*g* and 28*d*, come into close contact with each other, improving liquid-tightness and making it difficult to be distorted and hence coming off. Here, the diameter (inside diameter) of the inner peripheral side of the stepped reduced-diametric portion behind indented/projected engaging portion 14*d* of applying part rear end portion 14*b* is formed to be ϕ5.6 (:inside diameter of 5.6 (mm)), for instance.

Further, as shown in FIGS. 2 and 4, flange portion 30*d* is formed with a greater diameter at the rear end of the joint 30, so that the flange portion 30*d* is adapted to abut the rear end face of the front barrel 28 from behind when indented/projected engaging portion 14*d* on the inner peripheral side of the applying part rear end portion 14*b* is engaged with indented/projected engaging portion 30*b* on the outer peripheral side of the forward part of the joint 30 and when indented/projected engaging portion 14*e* on the outer peripheral side of the applying part rear end portion 14*b* is engaged with indented/projected engaging portion 28*b* on the inner peripheral side of the front barrel forward part. In this way, the flange portion 30*d* is arranged to abut the rear end of the front barrel 28 from behind, so that it is possible to reliably prevent joint 30 from slipping into front barrel 28.

As shown in FIGS. 1 and 2, an indented/projected engaging portion 10*d* such as an annular rib, projected portion or the like is formed on the inner peripheral side of front end portion 10*a* of barrel body 10 while an indented/projected engaging portion 28*f* is formed on the outer peripheral side of the rearward part of the front barrel 28, so that indented/projected engaging portion 10*d* on the inner peripheral side of the barrel body front end portion 10*a* is engaged with indented/projected engaging portion 28*f* on the outer peripheral side of the rearward part of front barrel 28, whereby the applying part 14 is fixed to the barrel body 10 by means of the joint 30 and the front barrel 28.

In the assembled state where the forward part of joint 30 is inserted into communication hole 36 of the applying part rear end portion 14*b* while the outer periphery of the applying part rear end portion 14*b* is covered by the forward part of front barrel 28 and the rearward part of front barrel 28 is fixed to barrel body front end portion 10*a*, the first engagement position where indented/projected engaging portion 10*d* on the inner peripheral side of barrel body 10's front end portion 10*a* and indented/projected engaging portion 28*f* on the outer peripheral side of the front barrel rearward part engage with each other and the second engagement position where indented/projected engaging portion 28*c* on the inner peripheral side of front barrel rearward part and indented/projected engaging portion 30*c* on the outer peripheral side of the rearward part of joint 30 engage with each other, are formed at the same position or at positions near to each other with respect to the axial direction. With this arrangement, the engaging force between front barrel 28 and joint 30 does not depend on the elastic force of barrel body 28 but the elastic force of barrel body 10 is also added, so that joint 30 is more unlikely to come off from front barrel 28. Further, since, in embodiment 1, the application surface configuration at the tip of applying part 14 is formed to be flat, a greater contact area comes into contact with the target site so that application performance is improved.

Next, embodiment 2 will be described.

FIG. 6 is an illustrative view of an applying part of a liquid applicator according to embodiment 2 of the present invention, FIG. 6(*a*) a side view of an applying part 14, (*b*) a vertical sectional view of applying part 14, (*c*) an underside view of applying part 14, (*d*) a front view of applying part 14, (*e*) a vertical sectional illustrative view showing a state where applying part 14 is assembled with a joint 30 and a front barrel 28, and (*f*) a side view of the same state.

Here, the other configurations are the same as those of embodiment 1, so that description of the same components is omitted by allotting the same reference numerals. Further, in FIG. 6, applying part 14 is assembled into a barrel body 10 by means of joint 30 and front barrel 28 in the same manner as embodiment 1, the illustration of barrel body 10 is omitted.

Since the applicator according to embodiment 2 is the same as the applicator according to embodiment 1 except in that applying part 14 is formed with a tip face 14*c* that is cut obliquely at the front end and swelled spherically, the inside diameter (flat inner surface portion 14*f*) of a communication hole 36B in an assembly part is made smaller and internal communication holes 36A and 36B are made smaller in diameter, the same components are allotted with the same reference numerals.

That is, applying part 14 has a cylindrical configuration with its front end cut obliquely forming a spherically swelled front end (tip face 14*c*1), and the tip face 14*c*1 has ejection port 14*a* formed on the side extended to the tip. Small-diametric communication hole 36A that communicates with the ejection port 14*a* is formed inside applying part 14. Formed in the rearward part of applying part 14 is large-diametric communication hole 36B that opens to the rear end portion 14*b* of the applying part. The rear end of small-diametric communication hole 36A opens to the front end of large-diametric communication hole 36B establishing communication with each other. In the second embodiment, small-diametric communication hole 36A occupies the most part inside applying part 14, and applying part 14 has a thick-film configuration.

The stepped reduced diametric portion near the rear end of large-diametric communication hole 36B forms an indented/projected engaging portion 14*d* on the inner peripheral side of the applying part. The outer peripheral side of applying part 14 is depressed stepwise so that this depression forms an indented/projected engaging portion 14*e*. In this way, the indented/projected engaging portion 14*e* of the present invention may include a depressed portion other than projected portions above the surface. In the second embodiment, in applying part 14, the inside diameter of indented/projected engaging portion 14*d* of large-diametric communication hole 36B of applying part rear end portion 14*b* is formed to be smaller than the outside diameter of the outer peripheral side of the forward part of joint 30 (preferably than indented/projected engaging portion 14*d*). Accordingly, when joint 30 has been fitted inside communication hole 36B, the forward part of joint 30 forces open the communication hole 36B so that joint 30 squeezes into applying part 14 and tightly engages with indented/projected engaging portion 30*b*. Here, the diameter (inside diameter) of the inner peripheral side of the stepped reduced-diametric portion behind indented/projected engaging portion 14*d* of applying part rear end portion 14*b* is formed to be ϕ4.5 (:inside diameter of 4.5 (mm)), for instance.

Now, description will be made on the engagement (fitting) relationship between engaging portions in the liquid applicator of the second embodiment when applying part 14, front barrel 28 and joint 30 have been assembled in barrel body front end portion 10*a*.

As shown in FIG. 6(*e*), in the assembled state where the forward part of joint 30 is inserted into communication hole 36B of the applying part rear end portion 14*b* while the outer periphery of the applying part rear end portion 14*b* is covered by the forward part of front barrel 28 and the rear end portion of front barrel 28 is fixed to barrel body front end portion 10*a* (not shown), the step of indented/projected engaging portion 14*d* on the inner peripheral side of the applying part rear end portion 14*b* is abutted from behind against and engaged with the step of indented/projected engaging portion 30*b* on the outer peripheral side of the forward part of the joint 30. In this case, the outer peripheral side of the forward part of joint 30 is set into a state where applying part rear end portion 14*b* is squeezed in a pushing and spreading direction.

Further, the inner peripheral side of the forward part of front barrel 28 holds down so that applying part rear end portion 14*b* will not be enlarged in diameter. Indented/projected engaging portion 14*e* on the outer peripheral side of the applying part rear end portion 14*b* is abutted against and engaged with indented/projected engaging portion 28*b* on the inner peripheral side of the forward part of the front barrel 28 in a squeezing manner.

At the same time, indented/projected engaging portion 28*c* on the inner peripheral side of the front barrel rearward part is engaged with indented/projected engaging portion 30*c* on the outer peripheral side of the rearward part of joint 30. Thus, applying part 14, joint 30 and front barrel 28 are formed so as to fix the applying part 14 to barrel body 10 by means of the joint 30 and the front barrel 28. Since, in embodiment 2, the applying part is held with a strong force by squeezing the front end portion of joint 30 into applying part rear end portion 14*b* and holding down from the outside by front barrel 28, applying part 14 is more unlikely to come off compared to the liquid applicator of embodiment 1.

Further, in embodiment 2, since applying part 14 is configured so that the tip applying surface is formed to be a projected spherical surface, the applied cosmetic liquid will be less raked by another surface of the applying part after application to the target site, hence application performance is improved.

Next, the result of pull force measurement for each applying part 14 in the liquid applicators in embodiment 1 and embodiment 2 will be described. In this case, the diameter of the inner peripheral side (the inside diameter) of the stepped, reduced diametric portion behind indented/projected engaging portion 14*d* of applying part rear end portion 14*b* was formed to be 5.6 (mm) in inside diameter in embodiment 1 and 4.5 (mm) in inside diameter in embodiment 2.

In the measurement of pull force, the number n of liquid applicators for each of embodiment 1 and embodiment 2 were 10, the applying part and the front barrel held by clamps were pulled in a vertical direction by means of a commercially sold tension tester. The value of pull-out when they were separated was measured. The measurements of pull-out are given as follows. The unit N represents Newton.

Embodiment 1

Average; 22.6 (N), Maximum 25 (N), Minimum 20 (N)

Embodiment 2

Average; 52.3 (N), Maximum 56 (N), Minimum 50 (N)

As shown above, in embodiment 1, the average is 22.6 (N), which gives a pull-out resistance value free from problems for practical use. In embodiment 2, the value of pull-out is about twice as high as the value in embodiment 1, which means that the applying part is fixed more firmly compared to embodiment 1. Accordingly, it is understood that the liquid applicator of embodiment 2 is suitable for use in applying high-viscosity application liquids and for applying a liquid on a high-friction target surface.

Next, embodiment 3 will be described.

FIGS. 7 to 8 are illustrative views showing embodiment 3 of a liquid applicator according to the present invention.

As shown in FIGS. 7 to 8, in the liquid applicator according to embodiment 3, a joint 30 is an overall hollow cylindrical body having an application liquid passage hole 30*a* formed therein and indented/projected engaging portions 30*b* and 30*c* formed on the outer peripheral side in the front and rear while a front barrel 28 is an overall hollow cylindrical body having an indented/projected engaging portion 28*c* formed on the inner peripheral side in the rear.

In the assembled state where the forward part of joint 30 is inserted in a communication hole 36*b* of the applying part rear end portion 14*b* while the outer periphery of the applying part rear end portion 14*b* is covered by the forward part of front barrel 28 and the rear end portion of front barrel 28 is fixed to a barrel body front end portion 10*a*, an indented/projected engaging portion 14*d* on the inner peripheral side of the applying part rear end portion 14*b* is engaged with indented/projected engaging portion 30*b* on the outer peripheral side of the forward part of the joint 30. At the same time, an indented/projected engaging portion 28*c* on the inner peripheral side of the front barrel rearward part is engaged with indented/projected engaging portion 30*c* on the outer peripheral side in the rearward part of joint 30. Thus, applying part 14, joint 30 and front barrel 28 are formed so as to fix the applying part 14 to barrel body 10 by means of the joint 30 and the front barrel 28.

Here, in the liquid applicator of embodiment 3, indented/projected engaging portion 14*e* on the outer peripheral side of applying part rear end portion 14*b* and indented/projected engaging portion 28*b* on the inner peripheral side of the front barrel forward part in the liquid applicator of the embodiment 1 are not provided.

However, even if applying part 14 is pried during usage and the indented/projected engaging portion 14*d* on the inner peripheral side of applying part rear end portion 14*b* is going to be coming off from its engagement with indented/projected engaging portion 30*b* on the outer peripheral side of the forward part of joint 30, applying part rear end portion 14*b* will not expand more inside the inner peripheral side of front barrel 28 because the inner peripheral side of the portion of front barrel 28 that corresponds to applying part rear end portion 14*b* is located close to or in contact with applying part 14. As a result it is possible to prevent applying part 14, even if it is soft, from coming off. Embodiment 3 is able to make the front barrel configuration simple and simplify molding, compared to embodiment 1.

Since other configurations are the same as those of embodiment 1, the same components are allotted with the same reference numerals and description is omitted.

Now, the assembly of the liquid applicator according to embodiment 3 will be described in comparison with the liquid applicators of embodiments 1 and 2.

In the assembling process for embodiments 1 and 2, first, rear end portion 14*b* of applying part 14 is inserted into front barrel 28 from its front side and fitted therein (Step 1). Then, joint 30 is inserted forwards into the rear side of front barrel 28 with applying part 14 fitted therein, so that the joint is fitted into rear end portion 14*b* of applying part 14 (Step 2).

In contrast to this process, in embodiment 3 cylindrical front barrel 28 is slit in the longitudinal direction so as to allow temporal spread of the attachment portion. Accordingly, in the assembling process of embodiment 3, joint 30 is inserted into the rear of applying part 14 and fitted therein (Step 1), and the attachment portion (the part around indented/projected engaging portion 28*c* in the rearward part) of front barrel 28 is fitted to applying part 14 with this joint 30 fitted therein by spreading the slit temporarily.

It should be noted that the liquid applicator of the present invention should not be limited to the above-described embodiments 1 to 3, and it is apparent that various changes can be made therein without departing from the gist of the present invention.

INDUSTRIAL APPLICABILITY

The present invention can be used in the industrial field of liquid applicators for applying cosmetics, including a liquid applicator that stores an application liquid such as a fluid cosmetic or the like in a reservoir, has an applying part arranged at the front end of the barrel and made of a soft elastic body that is brought into contact with a target site such as a skin etc., and pushes out the application liquid stored in the reservoir by means of a delivering mechanism located at the end of the barrel, wherein the applying part capable of applying the application liquid to a target site such as a skin as it is being slid over the object site is disposed in the barrel so as not to fall off, as well as applicators such as writing instruments using ink as an application liquid, correction fluid corrector products, paint products for paints, adhesive products for adhesives and other various application liquids.

DESCRIPTION OF REFERENCE NUMERALS

1 liquid cosmetic applicator
10 barrel body
10*a* barrel body's front end portion (barrel body front end portion)
10*b* application liquid reservoir
10*c* cap
10*d* indented/projected engaging portion on the inner peripheral side of the front end portion
12 application liquid
14 applying part
14*a* ejection port
14*b* applying part rear end portion
14*c* tip face
14*d* indented/projected engaging portion on the inner peripheral side of the applying part
14*e* indented/projected engaging portion on the outer peripheral side of the applying part
14*f* flat surface portion on the inner peripheral side of the applying part
14*g* flat surface portion on the outer peripheral side of the applying part
16 delivering mechanism
18 piston body
20 shaft-like member
22 rotational actuator
24 fixed cylinder
26 inner sleeve
28 front barrel
28*a* space inside the front barrel
28*b* indented/projected engaging portion on the inner peripheral side of the front barrel forward part
28*c* indented/projected engaging portion on the inner peripheral side of the front barrel rearward part
28*d* flat surface portion on the inner peripheral side of the front barrel rearward part
28*f* indented/projected engaging portion on the outer peripheral side of the front barrel rearward part
30 joint
30*a* joint's application liquid passage hole
30*b* indented/projected engaging portion on the outer peripheral side of the joint forward part
30*c* indented/projected engaging portion on the outer peripheral side of the joint rearward part
30*d* flange portion at the joint rear end
30*e* flat surface portion on the outer peripheral side of the joint
32 outer cylindrical cap
34 meshing portion
36(36*a*, 36*b*) applying part's communication holes (small-diametric communication passage, large-diametric communication passage) (embodiments 1 and 3)
36A, 36B small-diametric communication hole, large-diametric communication hole (embodiment 2)

The invention claimed is:

1. A liquid applicator that stores an application liquid such as a fluid cosmetic or the like in a reservoir arranged in a barrel body, has an applying part that is fixed at a front end portion of the barrel body by means of a joint and a front barrel and brought into contact with a target site to apply the application liquid, and pushes out the application liquid stored in the reservoir toward the applying part by means of a delivering mechanism arranged in a rear of the barrel body wherein the applying part is an overall cylindrical body that is formed of a soft elastic material and has an opening as an ejection port at a tip thereof and a communication hole at a rear end thereof for creating communication from the ejection port and indented/projected engaging portions formed on an inner peripheral side and an outer peripheral side in a rear end portion, the joint is an overall hollow cylindrical body having an application liquid passage hole formed therein and indented/projected engaging portions formed on an outer peripheral side in a forward part and a rearward part, and the front barrel is an overall hollow cylindrical body having indented/projected engaging portions formed on an inner peripheral side in a forward part and a rearward part, and, in an assembled state where the joint forward part is inserted in the communication hole of the applying part rear end portion while an outer periphery of the applying part rear end portion is covered by the front barrel forward part and the front barrel rearward part is fixed to the barrel body front end portion, the indented/projected engaging portion on the inner peripheral side of the applying part rear end portion is engaged with the indented/projected engaging portion on the outer peripheral side of the joint forward part, and the indented/projected engaging portion on the outer peripheral side of the applying part rear end portion is engaged with the indented/projected engaging portion on the inner peripheral side of the front barrel forward part, at the same time the indented/projected engaging portion on the inner peripheral side of the front barrel rearward part is engaged with the indented/projected engaging portion on the outer peripheral side in the joint rearward part, whereby the applying part, joint and front barrel are formed so as to fix the applying part to the barrel body by means of the joint and the front barrel.

2. The liquid applicator according to claim 1, wherein, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, a spacing between the indented/projected engaging portion on the outer peripheral side of the joint forward part and the indented/projected engaging portion on the inner peripheral side of the front barrel forward part is formed to be narrower than a dimension between the indented/projected engaging portions on the inner and outer periphery surfaces of the applying part rear end portion so that the portion between the indented/projected engaging portions on the inner and outer peripheral surfaces of the applying part rear end portion is deformed by exerting compressive stress on that portion.

3. The liquid applicator according to claim 1, wherein inner and outer peripheries of the applying part rear end portion, joint outer periphery and front barrel inner periphery are formed with flat surface portions in areas other than respective indented/projected engaging portions, and, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the opposing flat surface portions on the applying part inner periphery and the joint outer periphery are formed so as to come into close contact with each other while the opposing surface portions on the applying part outer periphery and the front barrel inner periphery are formed so as to come into close contact with each other.

4. The liquid applicator according to claim 1, wherein a flange portion is formed with a greater diameter at a joint rear end, and, in the state where the indented/projected engaging portion on the inner peripheral side of the applying part rear end portion is engaged with the indented/projected engaging portion on the outer peripheral side of the joint forward part and the indented/projected engaging portion on the outer peripheral side of the applying part rear end portion is engaged with the indented/projected engaging portion on the inner peripheral side of the front barrel forward part, the flange portion is adapted to abut a rear end of the front barrel from behind.

5. The liquid applicator according to claim 1, wherein an indented/projected engaging portion is formed on an inner peripheral side of the front end portion of the barrel body while an indented/projected engaging portion is formed on an outer peripheral side of the front barrel rearward part, so that the indented/projected engaging portion on the inner peripheral side of the barrel body's front end portion is engaged with the indented/projected engaging portion on the outer peripheral side of the front barrel rearward part, whereby the applying part is fixed to the barrel body by means of the joint and the front barrel, and, in the assembled state, a first engagement position where the indented/projected engaging portion on the inner peripheral side of the barrel body's front end portion and the indented/projected engaging portion on the outer peripheral side of the front barrel rearward part are engaged with each other and a second engagement position where the indented/projected engaging portion on the inner peripheral side of the front barrel rearward part and the indented/projected engaging portion on the outer peripheral side of the joint rearward part are engaged with each other, are formed at the same position or at positions near to each other with respect to an axial direction.

6. The liquid applicator according to claim 1, wherein the applying part is configured so that a tip applying surface is formed to be a flat surface or a projected spherical surface.

7. The liquid applicator according to claim 1, wherein the applying part is formed of transparent or translucent silicone resin or urethane resin.

* * * * *